US012357134B1

(12) United States Patent
Dragonetti

(10) Patent No.: US 12,357,134 B1
(45) Date of Patent: Jul. 15, 2025

(54) BOWEL MOVEMENT AID

(71) Applicant: Gerald Christopher Dragonetti, Phoenixville, PA (US)

(72) Inventor: Gerald Christopher Dragonetti, Phoenixville, PA (US)

( * ) Notice: Subject to any disclaimer, the term of this patent is extended or adjusted under 35 U.S.C. 154(b) by 0 days.

(21) Appl. No.: 19/010,316

(22) Filed: Jan. 6, 2025

Related U.S. Application Data

(63) Continuation-in-part of application No. 18/609,117, filed on Mar. 19, 2024.

(51) Int. Cl.
*A47K 17/02* (2006.01)

(52) U.S. Cl.
CPC ..... *A47K 17/028* (2013.01)

(58) Field of Classification Search
CPC ..... A47K 17/02–028; A47K 2017/006; A61G 5/128; A61G 5/14; A61G 7/053–0533; A61G 7/1007; A61G 7/1038; A63B 21/00189; A63B 21/0442; A63B 23/0205; A63B 23/0211
See application file for complete search history.

(56) References Cited

U.S. PATENT DOCUMENTS 3,911,509 A * 10/1975 Fleckenstein ..... A61G 7/1038 182/15
4,932,090 A * 6/1990 Johansson ..... A61G 7/053 5/662
5,507,044 A * 4/1996 Williamson ..... A61G 7/1046 5/81.1 RP
6,148,448 A * 11/2000 Urso ..... A47K 17/026 297/423.44
10,835,433 B2 * 11/2020 Schwab ..... A61G 7/1007

* cited by examiner

*Primary Examiner* — David P Angwin
*Assistant Examiner* — Nicholas A Ros
(74) *Attorney, Agent, or Firm* — Joseph E. Maenner; Petock & Petock LLC

(57) ABSTRACT

A bowel movement aid device includes a leg support with a single support having a bottom end extending vertically from the leg support and a top end. The single support has a serpentine body extending between the bottom end and the top end. A hand grip assembly attached to the serpentine body has a first end and a second end extending at equal first and second distances from the single serpentine support. A first hand grip pole and a second hand grip pole extend upwardly from the first and second ends of the hand grip assembly respectively.

12 Claims, 7 Drawing Sheets

BOWEL MOVEMENT AID

BACKGROUND OF THE INVENTION

Field of the Invention

The invention relates to a device to assist persons while having bowel movements.

Description of the Related Art

Persons oftentimes have difficulty with bowel movements, whether due to constipation or other reason.

It would be beneficial to provide a device on which a person can grip and lean on while having a bowel movement.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a bowel movement aid device comprising a base, a support having a bottom end extending vertically from the base and also having a top end, and a cross-piece attached to the top end of the support and having a first end and a second end. A first grip pole extends upwardly from the first end of the cross-piece and a second grip pole extends upwardly from the second end of the cross-piece.

In an alternative embodiment, the present invention is a bowel movement aid device comprising a base, a support having a bottom end portion extending vertically from the base, and a top end telescopically connected to the bottom end. A first grip pole extends upwardly from the support. A second grip pole is spaced from the first grip pole. The second grip pole also extends upwardly from the support.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
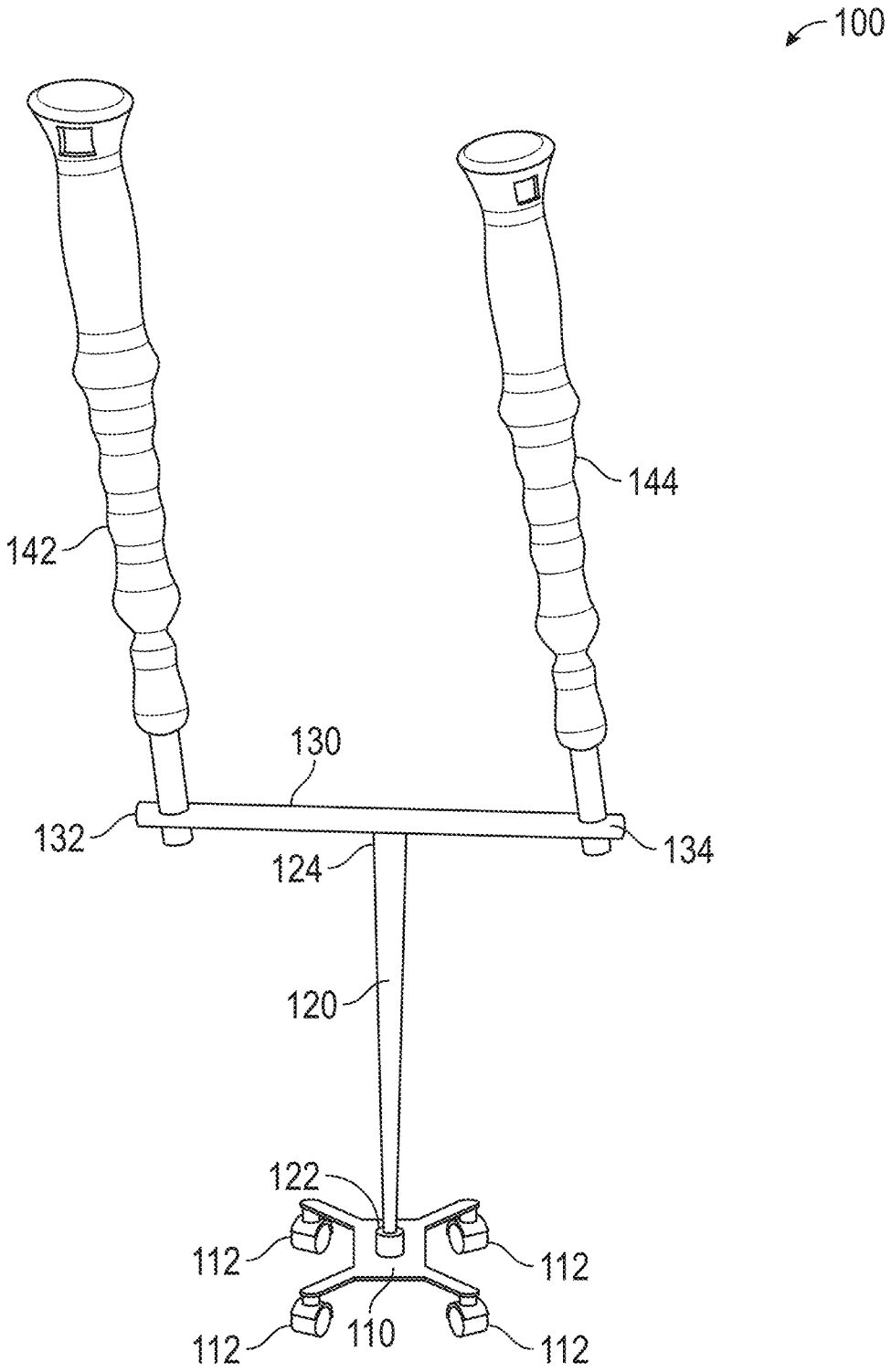
FIG. 1 is a perspective view of a bowel movement aid according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Provided is a bowel movement aid device 100 ("device 100") that can be used by a person who may need additional assistance in moving their bowels.

Referring to FIG. 1, device 100 includes a base 110 used to support device 100 on a floor "F". In an exemplary embodiment, base 110 includes a plurality of feet 112 extending outwardly therefrom. Further, feet 112 can be covered in a resilient material, such as rubber, to avoid marring floor F and to also provide a frictional engagement with floor F to prevent base 110 from slipping or sliding during use.

A support 120 has a bottom end 122 extending vertically from the base 110 and a top end 124. Bottom end 122 can be a first support portion telescopically inserted into top end 124, which is a second support portion. Support 120 extends along a vertical axis 126.

A cross-piece 130 is attached to the top end 124 of the support 120 and has a first (left) end 132 having a first length and a second (right) end 134 having a second length, the same as the first length.

A first grip pole 140 extends upwardly from the first end 132 of the cross-piece 130 and a second grip pole 142 extending upwardly from the second end 134 of the cross-piece 130, wherein the second grip pole 142 is spaced from the first grip pole 140 by a generally constant distance, such that the first grip pole 140 and the second grip pole 142 extend parallel to each other.

An alternative embodiment of a bowel movement aid device 200 ("device 200") includes a support 220 extending along an axis 221 and having a bottom end portion 222 extending vertically from the base 110, and a top end 224 telescopically connected to the bottom end 222 so that a vertical height of device 200 can be selectively adjusted by the user in the direction of double arrow "H".

A cross-piece 230 extends along an axis 231 and has a central portion 232 fixed to the top end 224 of the support 220, a left end portion 234 telescopically connected to the central portion 232, and a right end portion 236 telescopically connected to the central portion 232. The left end portion 234 is attached to the first grip pole 140 and the right end portion 236 is attached to the second grip pole 142.

Figure 2:
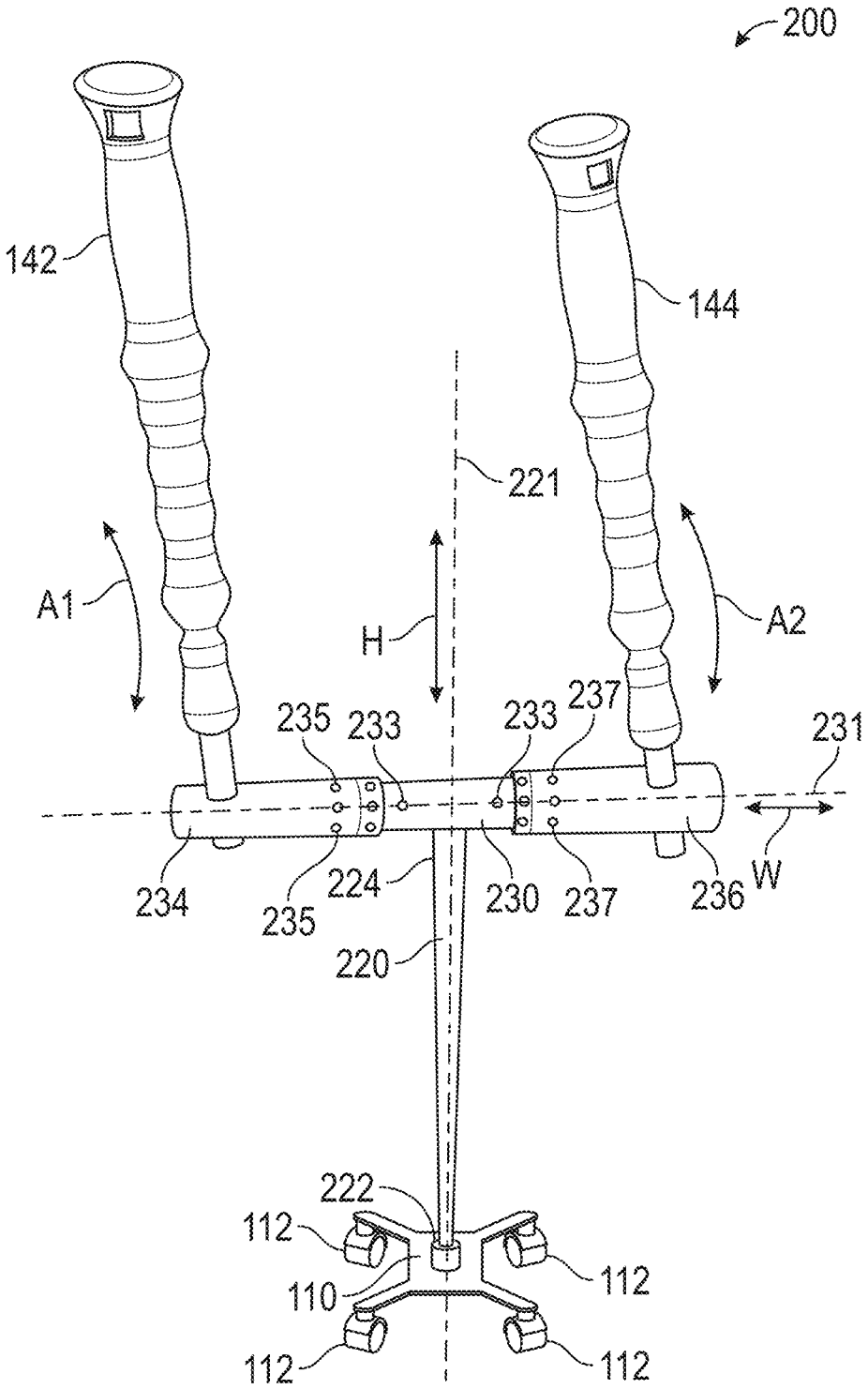
FIG. 2 is a perspective view of a bowel movement aid according to a second exemplary embodiment of the present invention.

The telescoping cross piece 230 allows the spacing between first and second grip poles 140, 142 to be adjusted along axis 231 in the direction of double arrow "W" to meet the needs of the user. Also, left end portion 234 and right end portion 236 are each independently rotatable about axis 231 to adjust the distance of first and second grip poles 140, 142 from the user, as well as an angle of first and second grip poles 140, 142 relative to cross piece 230, as shown in FIG. 2, which shows independent rotation of first and second grip poles 140, 142 along arcs "A1" and "A2", respectively. Slots 235, 237 on left and right end portions 234, 236, respectively, can be aligned with respective slots 233 on cross piece 230 and secured with pins (not shown) to maintain the desired spacing and/or rotation of first and second grip poles 140, 142 relative to each other and to axis 231.

Figure 3:
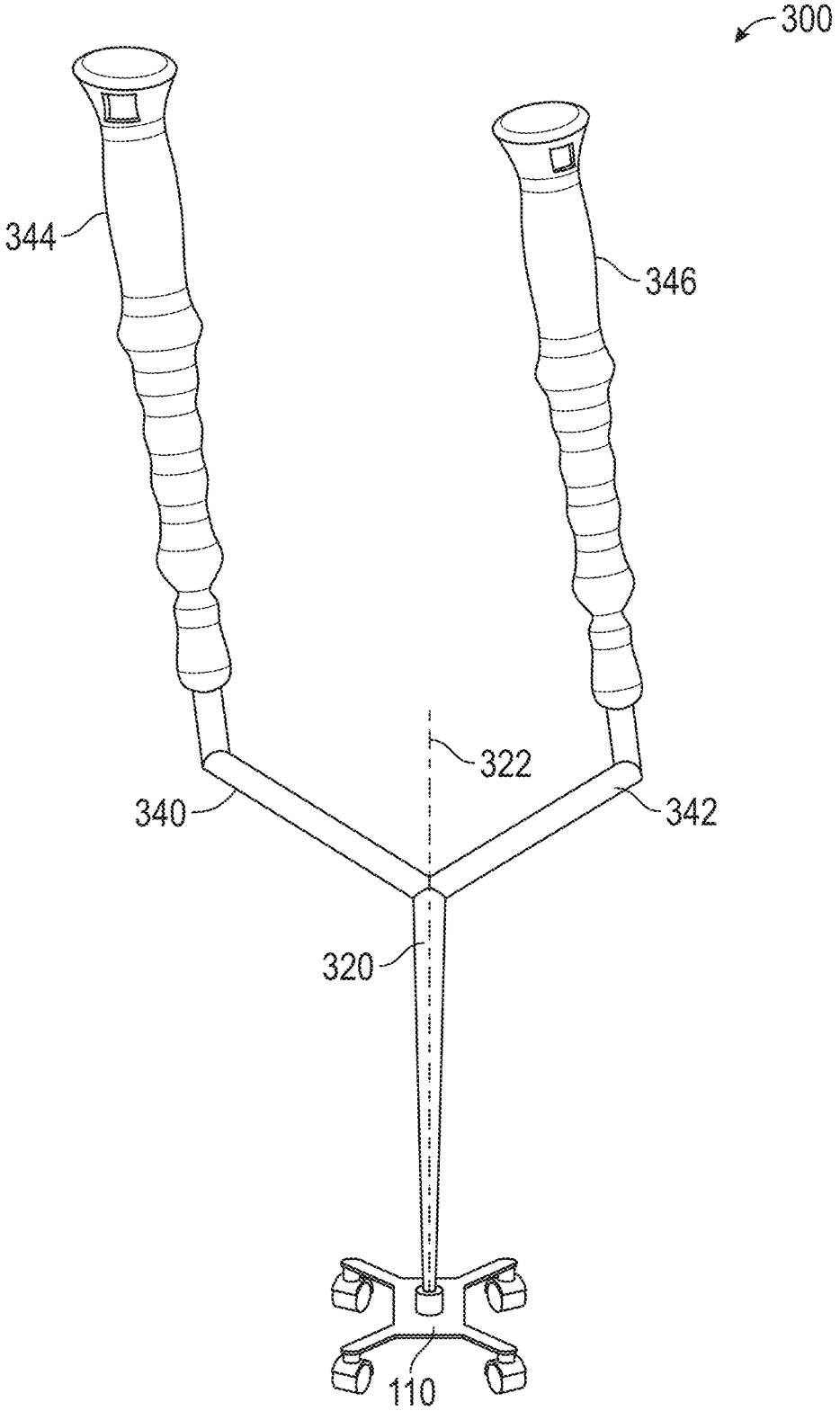
FIG. 3 is a perspective view of a bowel movement aid according to a third exemplary embodiment of the present invention.

An alternative embodiment of a bowel movement aid device 300 ("device 300"), shown in FIG. 3, includes a support 320 extending along a vertical axis 322, and first and second grip poles 340, 342 that each extend obliquely from support 320 relative to the vertical axis 322, omitting the cross piece 130, 230 from the prior embodiments. Grip poles 240, 342 can then angle to become parallel to each other along sections 344, 346. In this embodiment, the first and second grip poles 340, 342 extend away from each other.

In use, for any of devices 100, 200, 300, the user, while seated on a commode (not shown), can grip each of the first and second grip poles 140, 142 for support while performing a bowel movement. Devices 100, 200, 300 provide stability and support for the user during the bowel movement.

Figure 4:
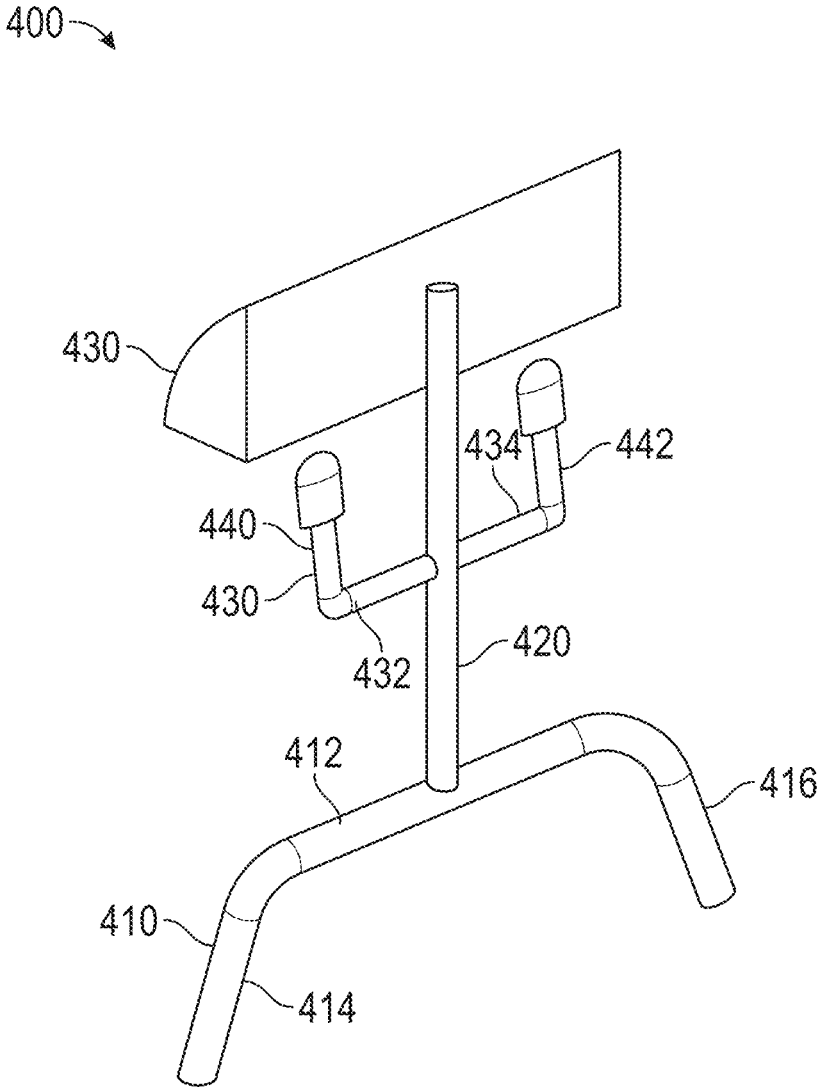
FIG. 4 is a perspective view of a bowel movement aid according to a fourth exemplary embodiment of the present invention.

Another alternative embodiment of a bowel movement aid device 400 ("device 400") is shown in FIG. 4. Instead of a base or feet, device 400 includes a leg brace assembly 410 extending generally horizontally relative to a single vertical support 420. Leg brace assembly 410 includes a horizontal support 412 that is sufficiently long to extend over both thighs of a user (not shown). Leg braces 414, 416 extend downwardly from wither end of support 412 to provide a surface for legs to force against while keeping device 400 in place on top of user's thighs.

A hand grip assembly 430 is attached to the vertical support 420 and has a first end 432 and a second end 434. The first end 432 extends a first distance from the vertical support 420 and the second end 434 extends a second distance from the vertical support 420. The second distance is the same as the first distance.

A first hand grip pole 440 extends upwardly from the first end 432 of the hand grip assembly 430 and a second hand grip pole 442 extends upwardly from the second end 434 of the hand grip assembly 430. The first hand grip pole 440 and the second hand grip pole 442 extend parallel to each other.

A chest support 450 extends above grip poles 440, 442 and is sized to allow the user to lean his chest into during use.

In use, while seated on a commode (not shown), the user places device 400 on the tops of his thighs such that horizontal support 412 rests on top of the thighs and the thighs are located between leg braces 414, 416. The user grips the grip poles 440, 442 with either hand and leans his chest into chest support 450.

Figure 5:
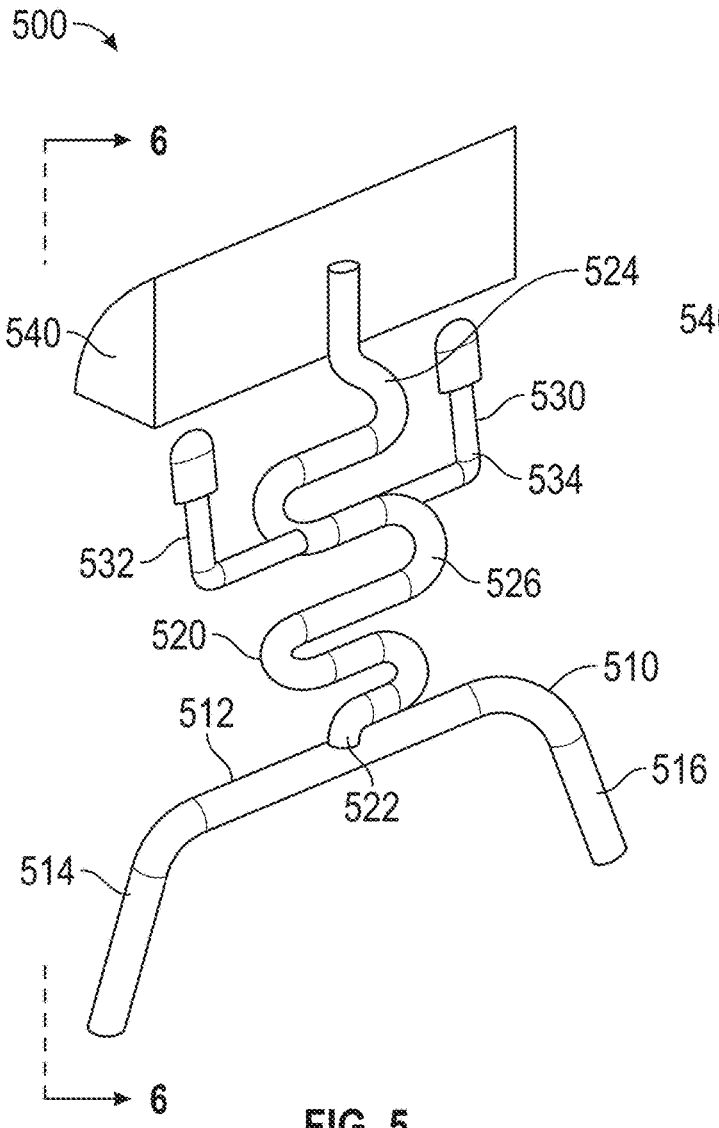
FIG. 5 is a perspective view of a bowel movement aid according to a fifth exemplary embodiment of the present invention.
Figure 6:
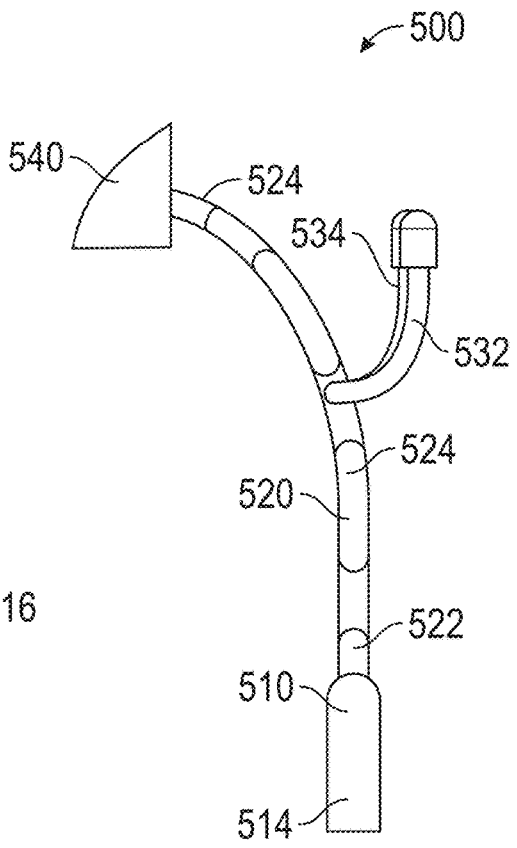
FIG. 6 is a side elevational view of the aid of FIG. 5, taken along lines 6-6 of FIG. 5.

Another alternative embodiment of a bowel movement aid device 500 ("device 500") is shown in FIGS. 5 and 6. Device 100 includes a leg support 510 with a single support 520 having a bottom end 522 extending vertically from the leg support 510, and a top end 524. The single support 520 has a serpentine body 526 extending between the bottom end 522 and the top end 524. A chest pad 540 is attached to the top end 524 of the single support 520.

The leg support 510 comprises a single inverted U-shaped frame 512 having first and second lower legs 514, 516 spaced apart from each other to allow a user's legs to fit therebetween. A hand grip assembly 530 is attached to the serpentine body 520 and has a first hand grip pole 532 and an opposing hand grip pole 534.

The serpentine body 520 is constructed from a carbon fiber material and, as shown in FIG. 6, curves in a concave manner between the leg support 510 and the chest pad 540. The serpentine body 520 from chest pad 540 deflects vertically upon application of a vertical force thereto.

Figure 7:
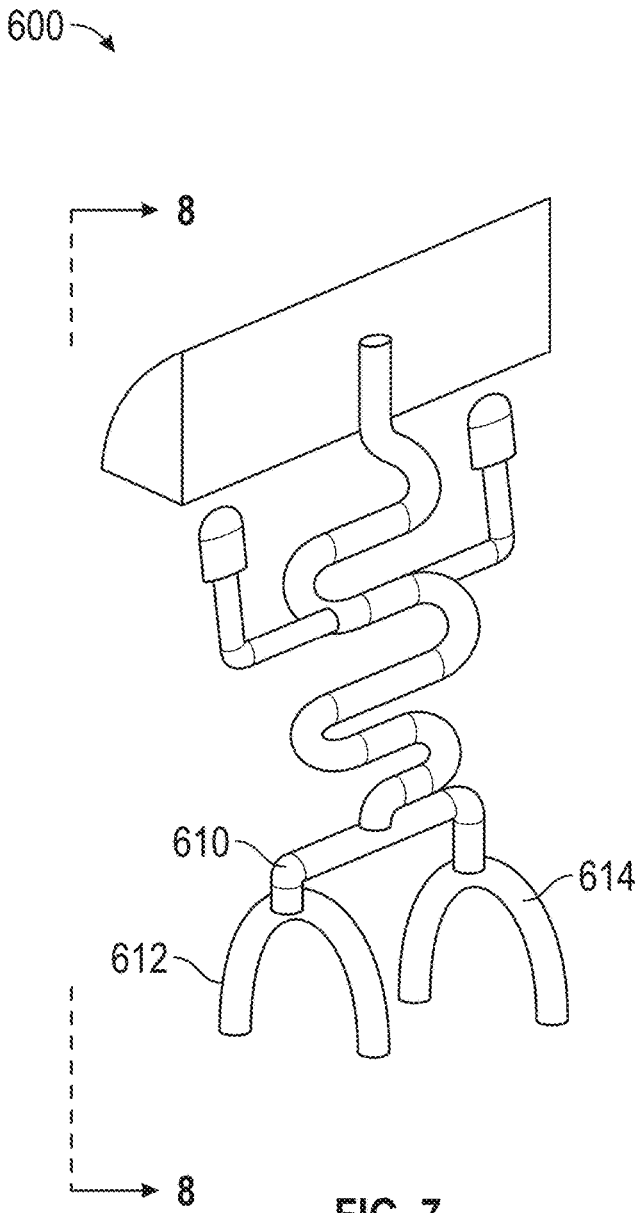
FIG. 7 is a perspective view of a bowel movement aid according to a sixth exemplary embodiment of the present invention.
Figure 8:
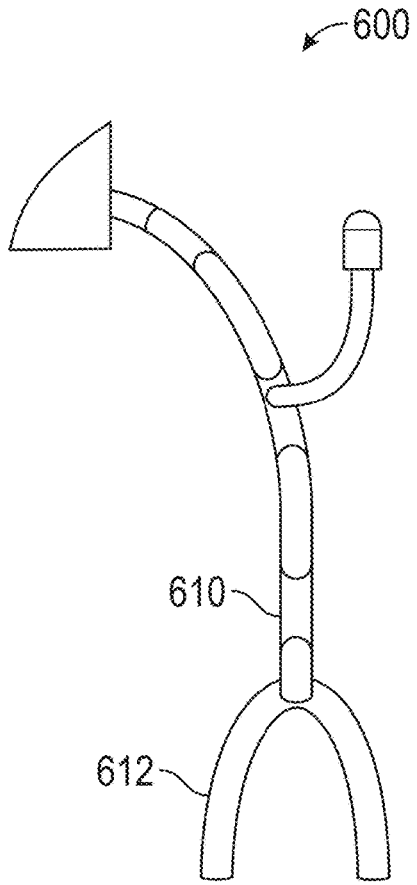
FIG. 8 is a side elevational view of the aid of FIG. 7, taken along lines 8-8 of FIG. 7.

Referring now to FIGS. 7 and 8, another alternative embodiment of a bowel movement aid device 600 ("device 600") is shown. Device 600 is similar to device 500 but, instead of a leg support 510 with a single spaced opening between leg braces 514, 516, leg support 610 comprises a pair of inverted U-shaped frames 612, 614, each frame 612, 614, being sized to fit over a thigh of a user (not shown).

The remainder of device 600 can be the same as device 500 and can be used in the same way as device 500.

Figure 9:
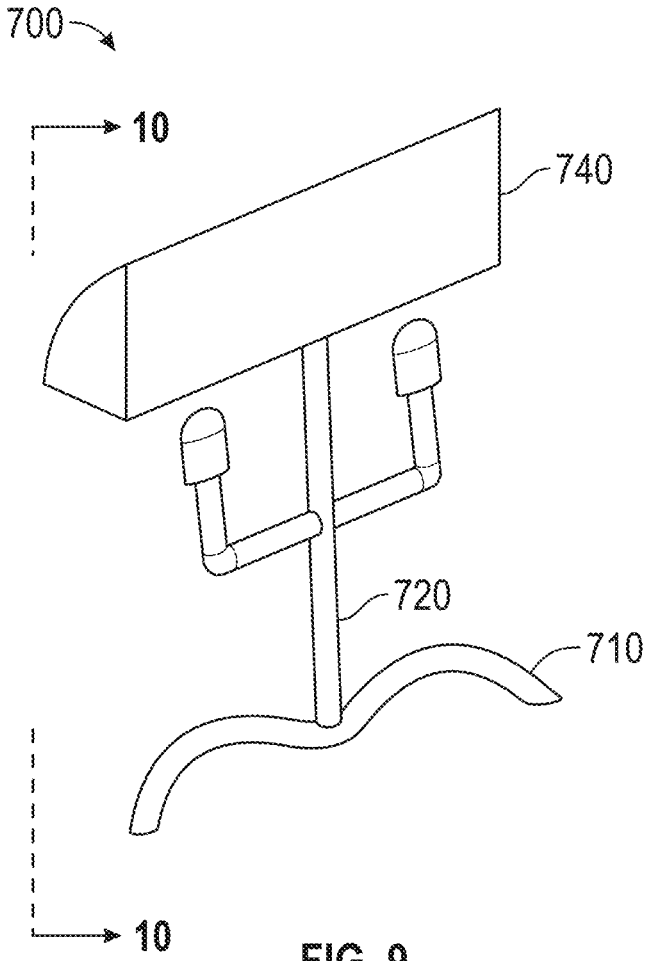
FIG. 9 is a perspective view of a bowel movement aid according to a seventh exemplary embodiment of the present invention.
Figure 10:
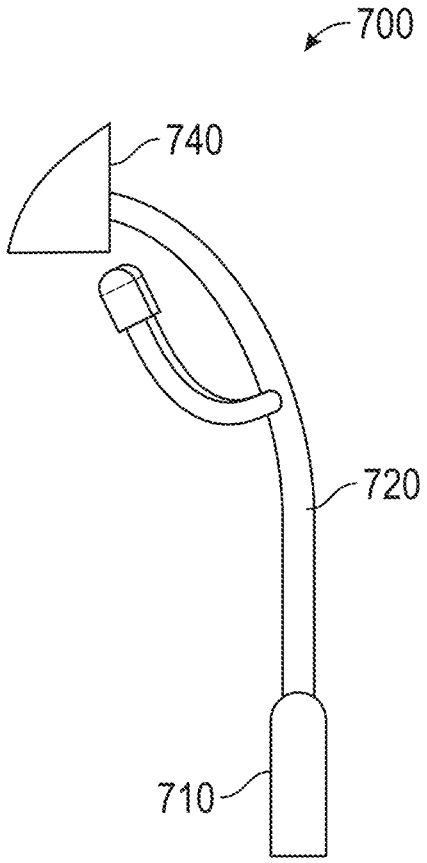
FIG. 10 is a side elevational view of the aid of FIG. 9, taken along lines 10-10 of FIG. 9.

Referring now to FIGS. 9 and 10, another alternative embodiment of a bowel movement aid device 700 ("device 700") is shown. Device 700 is similar to device 500 but, instead of a serpentine body 520, body 720 extends vertically between a chest pad 740 and a leg support 710. Body 720 is constructed from a carbon fiber material and, as shown in FIG. 10, curves in a concave manner between the leg support 710 and the chest pad 740. The body 520 from chest pad 740 deflects vertically upon application of a vertical force thereto.

The remainder of device 700 can be the same as device 500 and can be used in the same way as device 500.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A bowel movement aid device comprising:

a leg support;

a single support having a bottom end extending vertically from the leg support, and a top end, the single support having a serpentine body extending between the bottom end and the top end;

a hand grip assembly attached to the serpentine body and having a first end and a second end, the first end extending a first distance from the single support and the second end extending a second distance from the single support, the second distance being the same as the first distance;

a first hand grip pole extending upwardly from the first end of the hand grip assembly; and a second hand grip pole extending upwardly from the second end of the hand grip assembly.

2. The device according to claim 1, wherein the serpentine body is constructed from a carbon fiber material.

3. The device according to claim 1, wherein the serpentine body deflects vertically upon application of a vertical force thereto.

4. The device according to claim 1, wherein the first hand grip pole and the second hand grip pole extend parallel to each other.

5. The device according to claim 1, further comprising a chest pad attached to the top end of the single support.

6. The device according to claim 5, wherein the first and second hand grip poles extend parallel to each other.

7. The device according to claim 6, wherein the first and second hand grip poles extend away from each other.

8. The device according to claim 1 wherein the leg support comprises a single inverted U-shaped frame having first and second lower legs spaced apart from each other to allow a user's legs to fit therebetween.

9. The device according to claim 1 wherein the leg support comprises a pair of inverted U-shaped frames, each frame sized to fit over a thigh of a user.

10. A bowel movement aid device comprising:

a leg support comprising a pair of inverted U-shaped frames, each frame sized to fit over a thigh of a user;

a single support having a bottom end extending vertically from the leg support, and a top end, the single support having a serpentine body extending between the bottom end and the top end;

a hand grip assembly attached to the serpentine body and having a first end and a second end, the first end extending a first distance from the single support and the second end extending a second distance from the single support, the second distance being the same as the first distance;

a first hand grip pole extending upwardly from the first end of the hand grip assembly;

a second hand grip pole extending upwardly from the second end of the hand grip assembly; and a chest rest attached to the top end of the serpentine body.

11. The device according to claim 10, wherein the first hand grip pole extends parallel to the second hand grip pole.

12. The device according to claim 10, wherein the single support curves in a concave manner between the leg support and the chest rest.

* * * * *